United States Patent [19]

Davis

[11] 4,275,815

[45] Jun. 30, 1981

[54] LID

[75] Inventor: Paul Davis, Swampscott, Mass.

[73] Assignee: Sweetheart Plastics, Inc., Wilmington, Mass.

[21] Appl. No.: 53,993

[22] Filed: Jul. 2, 1979

Related U.S. Application Data

[63] Continuation of Ser. No. 688,987, May 24, 1976, abandoned, which is a continuation of Ser. No. 372,980, Jun. 25, 1973, abandoned.

[51] Int. Cl.[3] ..... B65D 21/02; B65D 43/00

[52] U.S. Cl. ..... 206/508; 206/519; 220/306

[58] Field of Search ..... 220/306, 355; 206/505, 206/507, 508, 509, 511, 515, 519, 520

[56] References Cited

U.S. PATENT DOCUMENTS

| | | | |
|---|---|---|---|
| Re. 28,797 | 5/1976 | Brewer | 206/508 X |
| 2,989,205 | 6/1961 | Yaws | 206/508 X |
| 3,362,565 | 1/1968 | McCormick | 229/43 X |
| 3,583,596 | 6/1971 | Brewer | 220/306 |
| 3,632,016 | 1/1972 | Bozek | 206/519 |
| 3,893,567 | 7/1975 | Davis et al. | 206/520 |

*Primary Examiner*—Steven M. Pollard

*Attorney, Agent, or Firm*—Wolf, Greenfield & Sacks

[57] ABSTRACT

A disposable plastic lid having a generally round closure wall and a depending skirt, with a stacking facility formed in the closure wall comprising a circular recess concentric with the wall and which recess has downwardly extending feet, substantially equal in circumferential extent and uniformly spaced about the periphery of the recess whereby the feet of one lid rest on the bottom wall of the recess of the next lower lid in the stack.

6 Claims, 9 Drawing Figures

FIG. 1
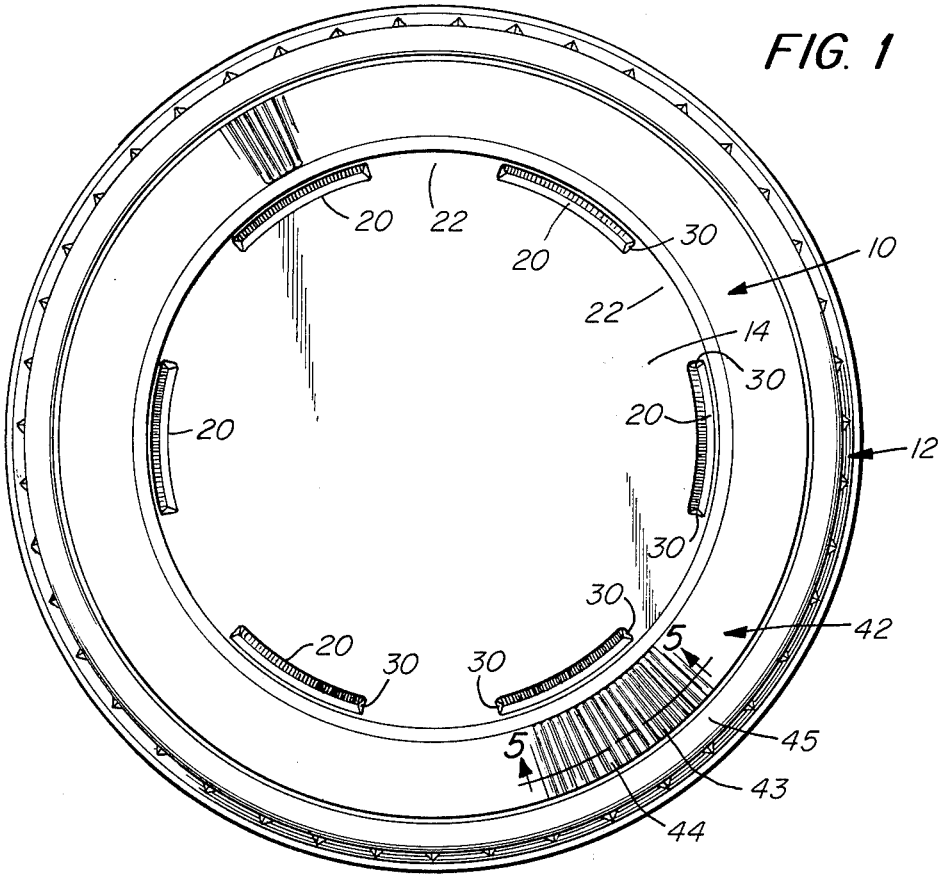
FIG. 2
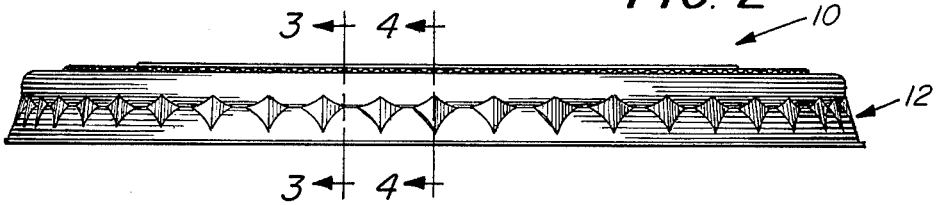
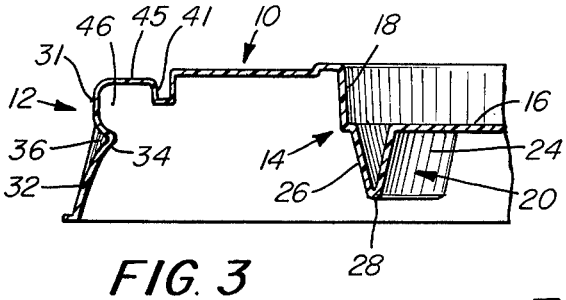
FIG. 3
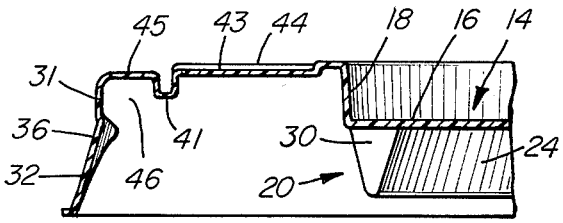
FIG. 4
FIG. 5
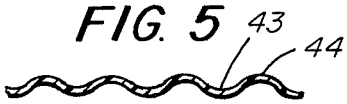

LID

This is a continuation of application Ser. No. 688,987, filed May 24, 1976, now abandoned, which is a continuation of application Ser. No. 372,980, filed June 25, 1973 and now abandoned.

BACKGROUND OF THE INVENTION

This invention relates to disposable, thin-wall, plastic lids and more particularly comprises a new and improved lid having a stacking facility which cooperates with other identical or very similar lids to form a very stable lid stack and to prevent jamming when axial loads are applied to them.

In the past 15 years considerable research has been directed to the design of stacking facilities in thin-wall, nestable articles such as lids and containers, to prohibit them from jamming when a plurality of such articles of identical form are arranged in a stack and subjected to axially applied loads. This research has been prompted by the rapidly growing use of disposable thermoformed plastic lids and containers in fast food establishments, vending machines and automatic filling equipment.

Many of the stacking facilities for thin wall, thermoformed, plastic articles are in the form of undercuts wherein the upper margin or shoulder of the undercut is supported at its inner edge by an upwardly and inwardly inclined intermediate wall. The undercut creates a positive interference between the upper and lower shoulders of adjacent containers, which interference exceeds the thickness of the wall of the article. There are certain disadvantages, however, to undercut stacking rings of that type. For example, the undercuts make it difficult to remove the articles from the mold cavities after they are formed, and special stripping mechanisms are frequently necessary to eject the articles from the cavities. Difficulties are also encountered in actually forming the details of the undercuts, and if the details are not formed well, the articles may jam together when an axial load is applied. In lids, it is the general practice to provide such undercuts in the skirt and because the skirts of the lids are particularly thin and lack rigidity, the stacking undercuts do not always perform well.

The stacking facilities of the general character found in the prior art, and particularly in flush-type lids designed for cold drink cups, do not create a very stable stack. Even though the stacking facilities may prevent axial jamming, they do not dependably maintain the lids in vertical alignment; rather, they permit the lids to slip sideways to create a rather sloppy pile of lids when the lids are not confined in a magazine or some special storage container. This is particularly troublesome when the lids are designed for over-the-counter use in fast food establishments where they are normally placed on a counter without any container about them so as to be readily accessible to those working at the counter.

One important object of this invention is to provide a stacking facility particularly designed for thin wall lids, which facility is free of undercuts and which nevertheless maximizes the interference of adjacent lids in a stack to prevent jamming.

Another important object of this invention is to provide a stacking facility particularly useful in lids, which lends great lateral stability to a stack of lids so that the lids may be vertically stacked by themselves in substantial numbers without falling over. Such a stacking facility is particularly useful in cold drink lids that have flat or only slightly recessed closure walls as opposed to those lids which have deeply recessed walls as are commonly used on hot drink cups.

Another important object of this invention is to provide a thin-wall disposable plastic lid specially fluted about the peripheral portion thereof so as to lend stiffness to what normally is the thinnest part of the lid made by the thermoforming technique.

Another important object of this invention is to provide a thin wall, stackable, disposable, plastic, thermoformed lid having a fluted configuration at the outer skirt which provides axial stiffness and circumferential flexibility.

Another important object of this invention is to provide a lid which will engage the bottom of a cup stacked on top of it to prevent the cup from slipping sideways off the lid so that filled and capped cups may be stacked on top of one another.

To accomplish these and other objects, the thin wall disposable plastic lid of this invention includes a stacking ring in the form of a circular recess formed on the closure wall, which recess has formed in its bottom wall a plurality of circumferentially spaced downwardly extending feet. When two identical lids are stacked together, the feet of the upper lid rest on the bottom wall of the recess of the lower lid to prevent the lids from jamming and/or moving sideways with respect to one another.

BRIEF FIGURE DESCRIPTION

FIG. 1 is a plan view of a lid constructed in accordance with this invention;

FIG. 2 is a side view thereof;

Figure 6:
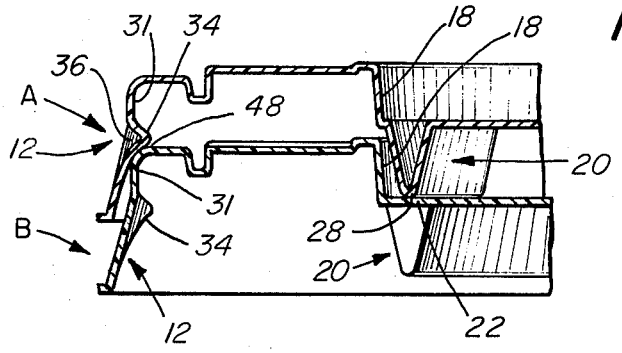
Figure 7:
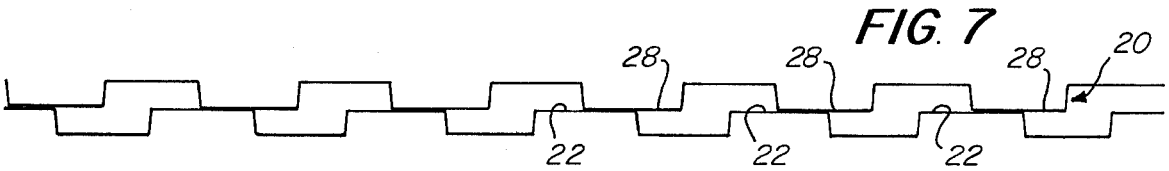
Figure 8:
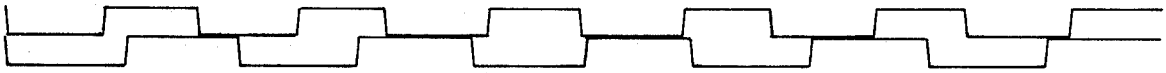
Figure 9:
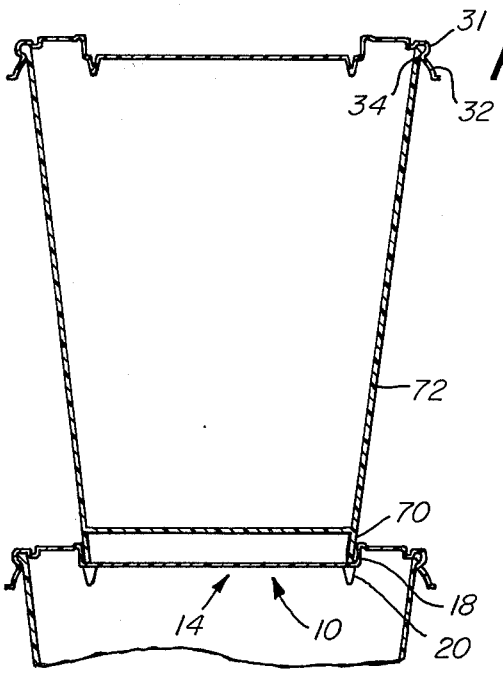

FIGS. 3 and 4 are enlarged fragmentary cross sectional views taken along the section lines 3—3 and 4—4 of FIG. 2;

FIG. 5 is an enlarged fragmentary cross sectional view taken along the section line 5—5 of FIG. 1;

FIG. 6 is an enlarged fragmentary cross sectional view of two identical lids as shown in FIGS. 1–5 stacked together;

FIG. 7 is a diagrammatic representation of the nesting facilities of the two lids shown in FIG. 6, and particularly illustrating the manner in which the nesting facilities cooperate to distribute support evenly about the lids and prevent jamming;

FIG. 8 is a view similar to FIG. 7 but showing how lids having slightly different stacking facilities nest with one another; and FIG. 9 is a fragmentary view showing stacked cups covered by the lids of this invention.

DETAILED DESCRIPTION

The lids shown in the drawings are disposable, plastic, thin wall lids which are designed for manufacture by conventional thermoforming techniques. The lids are particularly designed for one time use and typically may be used in fast food establishments as coverall lids for cold drinks. The lids are designed to be stacked with other identical or substantially identical lids and placed on a counter top with no special supports so that they may be freely taken from the stack one at a time as required by those working behind the counter.

The lid of FIGS. 1–5 includes a main generally horizontal closure wall 10 and a downwardly extending peripheral skirt 12. The skirt is designed to snap over the rim of a plastic or paper cup to form a sealed container. A nesting facility 14 in the form of a circular recess is formed in closure wall 10, concentric with the lid, to enable a plurality of lids to be stacked together without compacting. Recess 14 is defined by bottom wall 16, side wall 18, and downwardly extending feet 20.

The feet 20 are disposed adjacent side wall 18 at the periphery of bottom wall 16 and are circumferentially, equidistantly spaced. Moreover, as is shown in FIG. 1, the circumferential extent of each foot 20 is substantially equal to the space between adjacent feet. Thus, in the embodiment of this invention shown in FIG. 1, there are six feet 20 each approximately 30° in width in turn separated by six gaps 22 also approximately 30° wide.

Each foot 20 is generally V-shaped in cross section being defined by an inner downwardly and outwardly inclined wall 24 and an outer downwardly and inwardly inclined wall 26 joined together at a common bottom edge 28. The ends of each foot 20 are closed by V-shaped walls 30, which also converge downwardly slightly, toward one another. Thus, there are no undercuts formed in any of the feet 20.

For nesting purposes, the lower edges 28 of the feet serve as lower shoulders for the nesting facility 14, while the gaps 22 between the feet in bottom wall 16 serve as upper shoulders for the nesting facility. Therefore, when two lids as shown in FIGS. 1–5 are stacked together one above the other with the feet of one lid circumferentially displaced with respect to the other, the lower edges 28 of the upper lid feet rest on the gaps 22 between the feet on the bottom wall 16 of the lower lid. This arrangement is clearly shown in FIG. 6. It will be noted in that figure that the lower edge 28 of the upper lid A rests on the gap 22 of lower lid B. And when two such lids of identical configuration are nested together there is uniform support for the upper lid distributed about all of the feet of the upper lid.

Skirt 12 has an upper section 31 and a lower flared section 32 joined by an interrupted inwardly extending bead 34. Bead 34 is intended to engage the under side of the rim of the container with which it is used so as to retain the lid in place (see FIG. 9). Bead 34 is intermittently bridged by flutes 36 which extend vertically into rim receiving upper section 31 and lower flared section 32. Flutes 36 add resilience to rim 12 in the radial direction; that is, the flutes allow bead 34 to expand so as to readily snap over the rim of the container on which the lid is used. At the same time, flutes 36 lend axial stiffness to the skirt. Consequently the skirt does not readily crimp, curl or become otherwise deformed when being handled.

In FIG. 1 it will be observed that upper wall 10 has an annular portion 42 interrupted by a shallow recess 41 which is generally U-shaped in cross section and which extends about the lid. The recess divides the annular portion into inner and outer sections 43 and 45. The annular portion 43 is radially fluted as at 44 about its entire extent. The flutes generally add stiffness to the peripheral portion 42 of the wall 10 at that part of the wall which ordinarily is thin. When conventional techniques are employed to form the lid shown in the drawing, the material thins out in the region of the peripheral portion 42, and the radially extending flutes add some stiffness to that portion of the lid. This stiffness is particularly helpful in stripping the lid from the rim of the container. If the lid is too flexible, when the lid is peeled from the rim by the thumb and forefinger, the lid will tend to stretch in the pulled direction and bind on the sides of the cup rim in a direction transverse to the pull, and is consequently difficult to remove. However, when the stiffness is added to the lid structure by the use of the flutes 44, and the thumb and finger are used to lift the lid from the container rim at one point, the lid will tend to remain flat, pivot about the rim at a point 180° from where the lid is grasped and release the rim more readily.

The annular recess 41 in top wall portion 42 is provided to prevent identical lids from sticking together when the cup rim receiving portion 46 of one lid is forced upwardly into the cup rim receiving portion of the next upper lid in a stack. It is evident that when portion 46 of a lid is forced upwardly toward the like portion of the next upper lid in a stack, the outer annular wall 45 of the lower lid will engage the bottom of the recess 41 so as to limit the upward travel of the lower lid in the upper lid, and consequently the two lids will not jam or stick together at their periphery.

In FIG. 6, the outer edge 48 of outer annular wall portion 45 is shown to be in contact with and supporting skirt 12 of upper lid A by engaging bead 34 in that skirt. When the lids are scaled so that the peripheral edge 48 of one lid supports the bead 34 of the next upper lid simultaneously with the support provided by the feet 20, some additional stability is afforded a stack of nested lids. However, it is not essential that the feet 20 contact the gaps 22 simultaneously with contact of edge 48 with the bead 34. Because the lids are made of very thin and flexible material, it is not critical that contact be made at each location simultaneously. Rather, contact can be made first either at the skirt or at the nesting facilities and thereafter contact can take place at the alternate location. Alternatively, the lids can be designed so that there is no contact at the skirts of adjacent lids when the lids are stacked by their nesting facilities 14.

Referring once again to the nesting characteristics of the lid of this invention, it will be appreciated that when two identical lids are nested together, so long as the feet of adjacent lids are out of phase with one another, interference will exist between the upper and lower shoulders of the adjacent lids so as to prevent jamming as suggested by the diagram of FIG. 7. While it is unlikely that adjacent lids will become circumferentially aligned when stacked in random so that the teeth of the lids register with one another, occasionally this may occur, and to further resist jamming, in accordance with this invention the lids are manufactured with different numbers of feet. Thus, while in the embodiment shown in FIG. 1 there are six feet, other lids may be provided with different numbers. For example, other molds may form the lids with five feet (each having a circumferential extent of 36°) and yet other lids may have seven feet. This is suggested diagrammatically in FIG. 8. It will be apparent that when two dissimilar lids, (lids having different numbers of feet) are nested together, it is not possible for all of the feet of adjacent lids to be placed in phase, and interference must necessarily exist between upper and lower shoulders so as to insure against jamming.

In FIG. 6 it will be recognized that one lid in a stack of lids cannot move laterally with respect to the others because the feet of the upper lid lie just inside wall 18 of the next lower lid. That is, one lid in a stack cannot be sliced from the other other lids without upsetting the entire stack, and therefore a stack of lids will not easily tip over or fall into disarray, and the lids may be stacked in substantial numbers. The stack of lids is particularly stable. And the nesting recess of a lid to be withdrawn from the stack must be free of all interference from nesting recesses of adjacent lids. Therefore, the lids are ordinarily taken one at a time from a stack by lifting the uppermost lid off the top.

It is apparent from FIG. 9 that the nesting recess 14 performs yet another function, namely, it enables capped cups to be stacked on top of one another without falling. As shown in that figure the lower edge 70 of the side wall 72 of the upper cup rests on bottom wall 16 of the nesting recess of the lid capping the next lower cup, and the upper cup is prevented from sliding sideways and falling off the capped lower cup.

From the foregoing description those skilled in the art will appreciate that numerous modifications may be made of this invention without departing from its spirit. Therefore it is not intended to limit the breadth of this invention to the embodiments illustrated and described. Rather, it is intended that the breadth of this invention be determined by the appended claims and their equivalents.

What is claimed is:

1. A stack of disposable plastic circular container lids having a first disposable, plastic circular lid comprising:

a generally flat circular closure wall and an integral peripheral skirt extending away from the closure wall at a rim portion of said lid, and a stacking facility in the closure wall within an outer annular portion of said closure wall, said annular portion being divided into inner and outer sections by a generally U-shaped encircling recess defined by said portion, said inner section having radially extending stiffening flutes and said outer section defining a container rim seat, said recess comprising means to prevent adjacent lids from sticking together when one rim portion may be forced toward another rim portion, said stacking facility including a circular recess in the closure wall coaxial therewith, said recess having a bottom wall and surrounding circular side wall, said side wall extending away from the closure wall with said bottom wall being spaced from the plane of the closure wall, a plurality of feet extending from the bottom wall adjacent the side wall and extending away from the bottom wall, said feet being arranged in a substantially circular array, each of said feet having an outer, outwardly facing side wall of arcuate configuration conforming to a section of said circular side wall and defining a lower arcuate stacking edge, said lower arcuate stacking edges of said feet occupying approximately one-half of the circle defined by said feet, said feet tapering in a direction away from the bottom wall and being engageable with the bottom wall of an adjacent lid in a stack of substantially identical lids, said feet lying within and closely adjacent the recess side wall of said adjacent lid and said feet comprising means to prevent the lids from jamming under axially applied load and from slipping sideways with respect to each other so that a stack of such lids has great lateral stability, and a second lid corresponding to and overlying said first lid but having a second plurality of feet comprising a different number than said first lid.

2. Stacks of disposable, plastic circular lids as described in claim 1 further characterized by said feet of each lid extending from the bottom wall of each lid generally parallel to the side wall of each lid with the circumferential space between adjacent feet of each lid being substantially equal to the length of the feet of that lid.

3. A stack of disposable plastic circular container lids having a first disposable, plastic circular lid comprising:

a generally flat circular closure wall and an integral peripheral skirt extending away from the closure wall at a rim portion of said lid, and a stacking facility in the closure wall within an outer annular portion of said closure wall, said annular portion having inner and outer sections, said outer section defining a container rim seat, said stacking facility including a circular recess in the closure wall coaxial therewith, said recess having a bottom wall and surrounding circular side wall, said side wall extending away from the closure wall with said bottom wall being spaced from the plane of the closure wall, a plurality of feet extending from the bottom wall adjacent the side wall and extending away from the bottom wall, said feet being arranged in a substantially circular array, each of said feet having an outer, outwardly facing side wall of arcuate configuration conforming to a section of said circular side wall and defining a lower arcuate stacking edge, said lower arcuate stacking edges of said feet occupying approximately one-half of the circle defined by said feet, said feet tapering in a direction away from the bottom wall and being engageable with the bottom wall of an adjacent lid in a stack of substantially identical lids, said feet lying within said closely adjacent the recess side wall of said adjacent lid and said feet comprising means to prevent the lids from jamming under axially applied load and from slipping sideways with respect to each other so that a stack of such lids has great lateral stability, and a second lid corresponding to and overlying said first lid but having a second plurality of feet comprising a different number than said first lid.

4. Stacks of disposable, plastic circular lids as described in claim 3 further characterized by said feet of each lid extending from the bottom wall of each lid generally parallel to the side wall of each lid with the circumferential space between adjacent feet of each lid being substantially equal to the length of the feet of that lid.

5. A stack of disposable plastic circular container lids in accordance with claim 3 and further comprising, said first-mentioned lid having said annular portion being divided into said inner and outer sections by a generally U-shaped encircling recess defined by said portion, said outer section defining a container rim seat, said recess comprising means to prevent adjacent lids from sticking together when one rim portion may be forced toward another rim portion, said stacking facility including a circular recess in the closure wall coaxial therewith, said recess having a bottom wall and surrounding circular side wall, said side wall extending away from the closure wall with said bottom wall being spaced from the plane of the closure wall, a plurality of feet extending from the bottom wall adjacent the side wall and extending away from the bottom wall, said feet being arranged in a substantially circular array, each of said feet having an outer, outwardly facing side wall of arcuate configuration conforming to a section of said circular side wall and defining a lower arcuate stacking edge, said lower arcuate stacking edges of said feet occupying approximately one-half of the circle defined by said feet, said feet tapering in a direction away from the bottom wall and being engageable with the bottom wall of an adjacent lid in a stack of substantially identical lids, said feet lying within and closely adjacent the recess side wall of said adjacent lid and said feet comprising means to prevent the lids from jamming under axially applied load and from slipping sideways with respect to each other so that a stack of such lids has great lateral stability, and a second lid corresponding to and overlying said first lid but having a second plurality of feet comprising a different number than said first lid.

6. Stacks of disposable, plastic circular lids as described in claim 5 further characterized by said feet of each lid extending from the bottom wall of each lid generally parallel to the side wall of each lid with the circumferential space between adjacent feet of each lid being substantially equal to the length of the feet of that lid.

* * * * *